US008555587B2

(12) United States Patent
Hohmann, Jr.

(10) Patent No.: US 8,555,587 B2
(45) Date of Patent: Oct. 15, 2013

(54) RESTORATION ANCHORING SYSTEM

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 525 days.

(21) Appl. No.: 12/777,839

(22) Filed: May 11, 2010

(65) Prior Publication Data

US 2011/0277397 A1 Nov. 17, 2011

(51) Int. Cl.
*E04B 2/08* (2006.01)
*E04B 2/16* (2006.01)
*E04B 2/48* (2006.01)

(52) U.S. Cl.
USPC ..... 52/379; 52/705; 52/506.06; 52/391; 52/513

(58) Field of Classification Search
USPC ..... 52/391, 390, 506.06, 513, 512, 508, 52/379, 167.1, 705; 285/133.11
See application file for complete search history.

(56) References Cited

U.S. PATENT DOCUMENTS 3,321,883 A * 5/1967 Pascucci ..... 52/774
4,473,984 A * 10/1984 Lopez ..... 52/410
4,631,889 A 12/1986 Adam
4,772,166 A 9/1988 Shamah
4,875,319 A * 10/1989 Hohmann ..... 52/383
4,883,396 A 11/1989 Shamah
5,138,809 A * 8/1992 Saikachi ..... 52/235
5,454,200 A * 10/1995 Hohmann ..... 52/513
5,636,486 A * 6/1997 Hall ..... 52/383
5,644,889 A * 7/1997 Getz ..... 52/713
5,671,578 A * 9/1997 Hohmann ..... 52/562
5,816,008 A * 10/1998 Hohmann ..... 52/565
6,502,362 B1 * 1/2003 Zambelli et al. ..... 52/698
6,851,239 B1 * 2/2005 Hohmann et al. ..... 52/513
7,404,274 B2 7/2008 Hayes
7,568,320 B2 * 8/2009 Paterson et al. ..... 52/513
8,096,090 B1 * 1/2012 Hohmann et al. ..... 52/513

FOREIGN PATENT DOCUMENTS

EP 0150906 A2 8/1985
EP 0171250 A2 2/1986

OTHER PUBLICATIONS

Masonry Cracks: A review of the literature; Clayford T. Grimm (Special Technical Publications 992, 1998; American Society of Testing and Materials, Phila, PA 19103 pp. 257-276).

* cited by examiner

*Primary Examiner* — Phi Dieu Tran A
(74) *Attorney, Agent, or Firm* — Silber & Fridman

(57) ABSTRACT

A restoration anchoring system for use in cavity wall structures having an inner wythe and an outer wythe that requires remediation or re-anchoring is disclosed. The anchoring system employs a three-part system that is installed within the existing bed joints of the outer wythe to reattach and re-anchor the outer wythe to the structural inner wythe. The three-part system includes a helical dowel, a seismic T-clip and a reinforcement member. The helical dowel is self-threading and self-drilling. When the three-part system is installed within the outer wythe and attached to the inner wythe, the system is captively embedded in the outer wythe thereby providing a seismic construct.

27 Claims, 10 Drawing Sheets

RESTORATION ANCHORING SYSTEM

BACKGROUND OF THE INVENTION

1. Field of the Invention

This invention relates to a restoration anchoring system for cavity walls, and, more particularly to an anchoring system that remedies the fault that has occurred and constructs a repaired wall that withstands seismic and high-wind load conditions. The anchoring system includes a novel restoration seismic clip.

2. Background of the Prior Art

The construction of cavity walls consisting of an inner wythe or backup wall and an outer wythe or veneer is well known. During construction, the inner and outer portions are tied together by anchoring systems governed by local customs and building codes, which systems are designed to ensure structural integrity and to resist destructive forces.

The inventors' patents and their assignee's product line include masonry accessories, namely, ladder and truss reinforcements, wall anchors, veneer ties, masonry flashing and related items for cavity walls. These products, which are sold under the trademarks of Lox All, DW-10X, X-seal and Flex-Flash, are manufactured by Hohmann & Barnard, Inc., Hauppauge, N.Y. 11788 ("H&B"), a unit of MiTek Industries, Inc., a Berkshire Hathaway subsidiary. The products have become widely accepted in the construction industry and the inventors have gained particular insight into the technological needs of this marketplace.

From time-to-time or with the passage of time, cavity walls have been known to experience levels of instability requiring remediation. Instability may result from any of a number of causes, namely, inter alia: including improper installation of the original anchoring system; the corrosion of imbedded reinforcing steel, a seismic event; settlement of the building, unanticipated differences in thermal expansion; and, historic high-wind shear conditions. Such instability results in masonry veneer cracking and spalling, the most frequent cause of masonry performance failure and potentially dangerous to the building occupants and pedestrians.

Cracking and spalling requires remediation or restabilization of the veneer by opting to: (1) remove and replace the veneer; (2) remove and re-anchor partial or selective veneer sections; or, (3) re-anchor or mechanically retie the veneer to the inner wythe. Among these options typically complete removal of a veneer and subsequent replacement is impractical and expensive. Similarly, the partial removal of sections or stories of veneer is unsafe and costly. Thus, the third option of adding or replacing mechanical anchoring as the most practical, least invasive and most cost effective repair technique.

The remediation of a failed structure is in many ways more difficult than forming the original construct. This is especially the case with cavity walls as the operating space—the bed joint of the veneer—is already enclosed. In most cavity walls, the veneer bed joint is 0.375 inch in height and within this height the replacement anchoring needs to be embedded. In order to re-anchor the veneer, the mason must work within the bed joint space and carefully clear away just enough mortar to provide a space for installation of the new tie system without structurally damaging the veneer.

In the past, the cracking of masonry structures has received extensive attention both in academic and specifically in architectural engineering publications. Noteworthy among studies is the work of Clayford T. Grimm entitled *Masonry Cracks: A review of the literature* (Special Technical Publications 992, 1998; American Society of Testing and Materials, Phila, Pa. 19103 pp. 257-276).

The use of helical dowels or wall ties is the most cost-effective and least invasive way of retrofitting a connection between the veneer and the inner wythe of a building. The helical wall tie is either self-drilling, self-tapping or is installed into a pre-drilled pilot hole and cuts its own thread to form a flexible threaded connection between the veneer and the inner wythe. The helical form acts as a spring to absorb differential movement without inducing cracking. Once installed, the helical anchors resist veneer loading in both compression and tension. The helix of the helical dowel minimizes retention of water in the cavity by forming and releasing droplets of water to the masonry flashing portion.

Although not provided as a seismic system, the application of helical dowels to anchoring systems was disclosed in the European Patent Applications 015906 A2, filed Jan. 4, 1985, and 0171250 A2, filed Jul. 29, 1985 of William J. B. Ollis and William H. Ollis. The Ollis et al. patent applications describe emplacing a helical dowel into an undersized pilot hole and upon hammering, causing the helical fin to rotatingly cut into the pilot hole wall. Later, the inventors commercialized their product in the United Kingdom through the Heli-Fix Corporation.

While the Ollis helical dowel serves to reconnect the veneer to the inner wythe, it fails to provide a connection to a reinforcement wire that is set within the horizontal bed joint to form a seismic construct. The present invention discloses a novel system that employs a three piece novel reconstruction wall tie system. The novel system includes a helical wall tie, T-clip and reinforcement wire. The helical wall tie is installed using a hammer drill and secures the veneer to the inner wythe through the bed joint which is partially removed to allow for installation of the T-clip and the reinforcement wire. The exterior end of the helical wall tie and the reinforcement wire are set within the T-clip and secured therein with a mortar patch or sealant. A variation of the T-clip provides a corrugated portion to house the helical wall tie. The helical wall tie is spun into the corrugated portion. The present system is secure, economical and easy to install.

In addition to the patents set forth above, in preparing for this application the following patents and patent applications came to the attention of the inventors and are believed to be relevant to the further discussion of the prior art:

| Patent | Inventor | Issue Date |
|---|---|---|
| 4,473,984 | Lopez | Oct. 2, 1984 |
| 4,631,889 | Adam et al. | Dec. 30, 1986 |
| 4,772,166 | Shamah, et al. | Sep. 20, 1988 |
| 4,875,319 | Hohmann | Oct. 24, 1989 |
| 4,883,396 | Shamah et al. | Nov. 28, 1989 |
| 5,644,889 | Getz | Jul. 8, 1997 |
| 7,404,274 | Hayes | Jul. 29, 2008 |

FOREIGN PATENT DOCUMENTS

| Patent | Country | Filing Date |
|---|---|---|
| EP 0150906 A2 | GB | Jan. 4, 1985 |
| EP 0171250 A2 | GB | Jul. 29, 1985 |

U.S. Pat. No. 4,631,889—Adam, et al. —Issued Dec. 30, 1986 discloses a fixing device for use in cavity walls that employs a radially expandible ribbed sleeve element to lock a rod in a bore of a wall.

U.S. Pat. No. 4,473,984—Lopez—Issued Oct. 2, 1984 details a curtain-wall masonry-veneer anchor system that employs a threaded stud that is either coarsely threaded for self-tapping in predrilled masonry or self-drilling and self-tapping.

U.S. Pat. Nos. 4,772,166 and 4,883,396—Shamah, et al. —Issued Sep. 20, 1988 and Nov. 28, 1989, respectively disclose dual expansion and non-expansion anchors that are adjustable to the spaced positions of the inner and outer wythes. The inner non-expansion anchor is self-drilling and self-threading.

U.S. Pat. No. 5,644,889—Getz—Issued Jul. 8, 1997 provides a remedial wall anchor system that includes a tie rod, securing components and a capturing device. The capturing device is disclosed as being able to connect a reinforcement rod or wire. The Getz's device contains numerous component parts.

U.S. Pat. No. 4,875,319—Hohmann—Issued Oct. 24, 1989 describes a seismic construction system for use in a cavity wall. The seismic construction system includes a veneer anchor which is attached to the inner wythe, a tie member attached to the veneer anchor and a channeled seismic clip attached to the tie. The seismic clip houses a continuous reinforcing wire, which is embedded in the mortar joint of the veneer.

U.S. Pat. No. 7,404,274—Hayes—Issued Jul. 29, 2008 discloses a plastic anchoring device for reinforcing and renovating an existing masonry wall. The anchor is inserted into the wall and then filled with cement, forcing radial expansion.

None of the above references provide the advancements in restoration anchoring systems for cavity walls as set forth herein. The present novel three-part system offers an easy to use, cost effective and high strength solution to re-anchoring a damaged veneer. Through the use of the present novel restoration anchoring system for cavity walls, code requirements are met and construction costs are reduced.

The present invention provides an advancement in veneer re-anchoring and reinforcement by providing a restoration anchoring system for cavity walls that provides the same or better stability than the original embedded anchoring system. The present invention solves problems relating to seismic reinforcement and re-anchoring of the veneer by providing a three-part system that minimizes reconstruction of the veneer. The present anchoring system resolves past problems relating to re-anchoring, while simultaneously reducing installation, labor and energy costs, thereby saving time and money.

As will become clear in reviewing the disclosure which follows, the restoration anchoring system benefits from the recent developments described herein that leads to solving the problems of re-anchoring and reconstructing a cavity wall structure efficiently, from both a structural as well as a cost/time perspective.

SUMMARY

In general terms, the restoration anchoring system for cavity walls disclosed hereby is an integral part of the remediation and re-anchoring of existing cavity wall veneers. The anchoring system employs a three-part system and works within the existing bed joint space without causing further damage to the existing veneer. The three-part system includes a helical dowel, a seismic T-clip and a reinforcement member. The helical dowel has a leading end and a trailing end and is threaded through a pilot hole in the outer wythe for securement to the inner wythe. The T-clip has a connector channel to house the trailing end of the helical dowel and at least one reinforcement channel to house the reinforcement member(s). Upon installation of the three-part system in the cavity wall structure, the system is captively embedded in the veneer.

A second embodiment of the present anchoring system employs a restoration anchoring system with a helical dowel that has a leading end and a trailing end. The helical dowel further contains a core portion and a vane portion. The vane portion is helically disposed around the core portion at a predetermined helix angle. The vane portion is designed for self-threading screwing through an opening in the veneer for securement in the inner wythe. The restoration anchoring system also utilizes a seismic T-clip and a reinforcement member and is captively embedded in the veneer.

A third embodiment of this invention reattaches a veneer to an inner wythe having metal studs. The three-part restoration system includes a helical dowel having a leading end and a trailing end. The helical dowel further contains a core portion and a vane portion helically disposed about the core portion at a predetermined helix angle. The leading end of the helical dowel includes a self-drilling portion for securement in the inner wythe. The seismic T-clip contains a connector channel to receive the trailing end of the helical dowel and at least one reinforcement channel for receiving at least one reinforcement member. The T-clip contains a base portion and a pair of sidewall portions spaced apart and extending from the base member about the connector channel. The sidewall portion contain lip portions and corrugations to secure the helical dowel within the connector channel. Upon installation of the three-part system in the cavity wall structure, the system is captively embedded in the veneer.

OBJECTS AND FEATURES OF THE INVENTION

It is an object of the present invention to provide in a restoration seismic anchoring system for a cavity wall having a facing wythe and a backup wythe the system including a wythe connector, a seismic T-clip, and a continuous wire reinforcement in the mortar joint of the facing wythe.

It is another object of the present invention to provide labor-saving devices to aid in remedial anchoring of seismic-type installations of brick and stone veneer and the securement thereof to an inner wythe.

It is a yet another object of the present invention to provide a restoration anchoring system comprising a limited number of component parts that are economical of manufacture resulting in a relatively low unit cost.

It is a feature of the present invention that the helical dowels thereof after being threadedly inserted in the backup wythe has the free end thereof, embedded in a bed joint of the facing wythe and is tied together with the continuous reinforcement element.

It is another feature of the present invention that the restoration T-clip hereof ties together the wythe connector and the continuous wire reinforcement in a positive manner.

It is a further feature of the present invention that the restoration anchoring system hereof restricts lateral and horizontal movements of the facing wythe with respect to the inner wythe.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
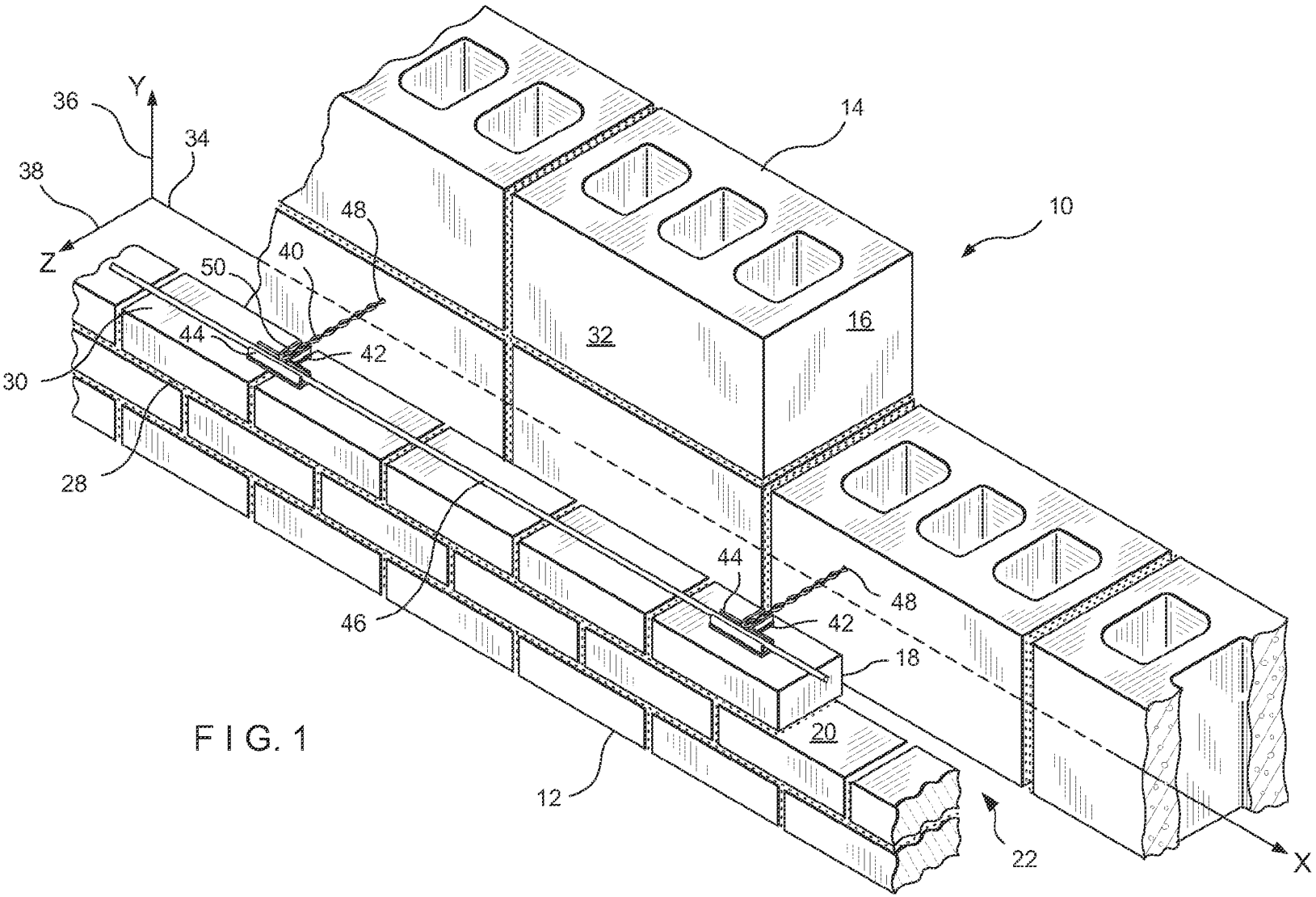
FIG. 1 is a perspective view of a first embodiment of a restoration seismic anchoring system for a cavity wall with an inner wythe of masonry block and an outer wythe of brick veneer having the bed joints thereof refitted to withstand seismic exposure.
Figure 2:
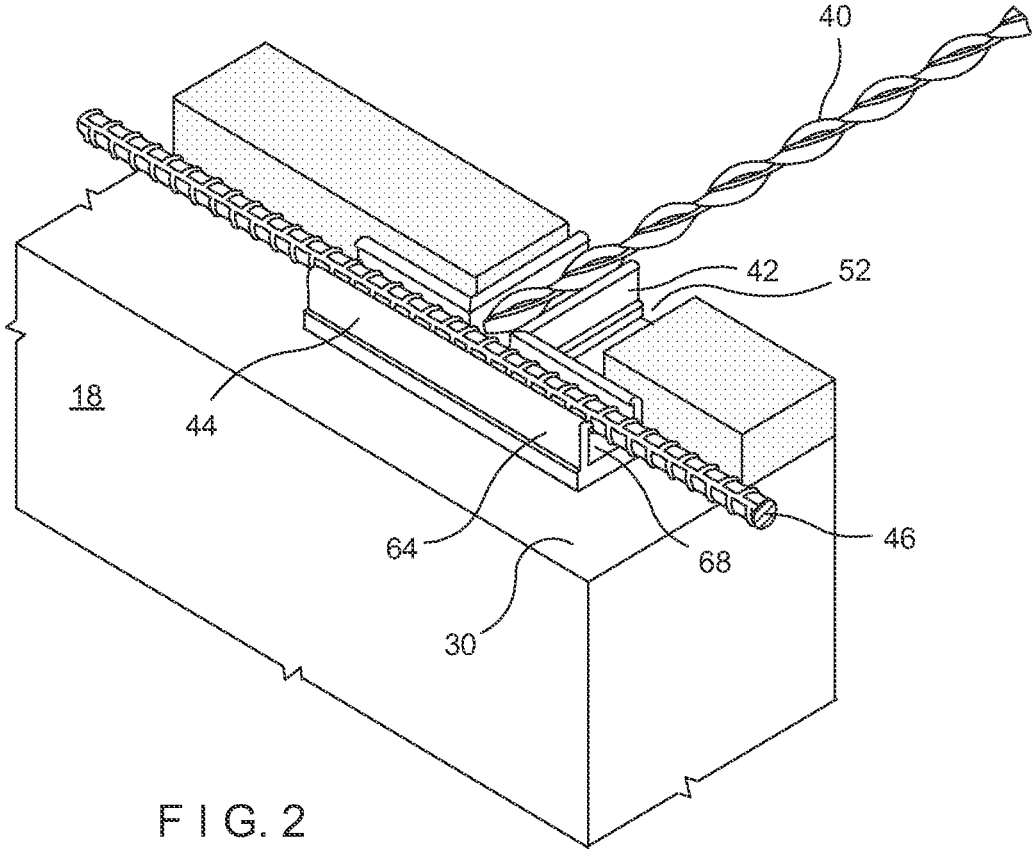
FIG. 2 is a cross-sectional view of FIG. 1 showing details of the wythe connector, the seismic T-clip, and the reinforcement wire; taken along an xz-plane including the longitudinal axis of the wall anchor.
Figure 3:
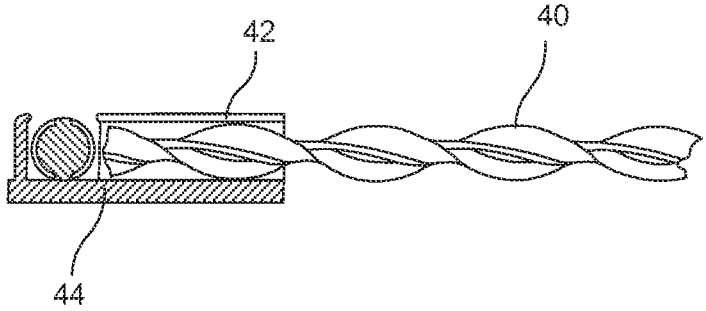
FIG. 3 is a cross-sectional view of the anchoring elements of FIG. 2.
Figure 4:
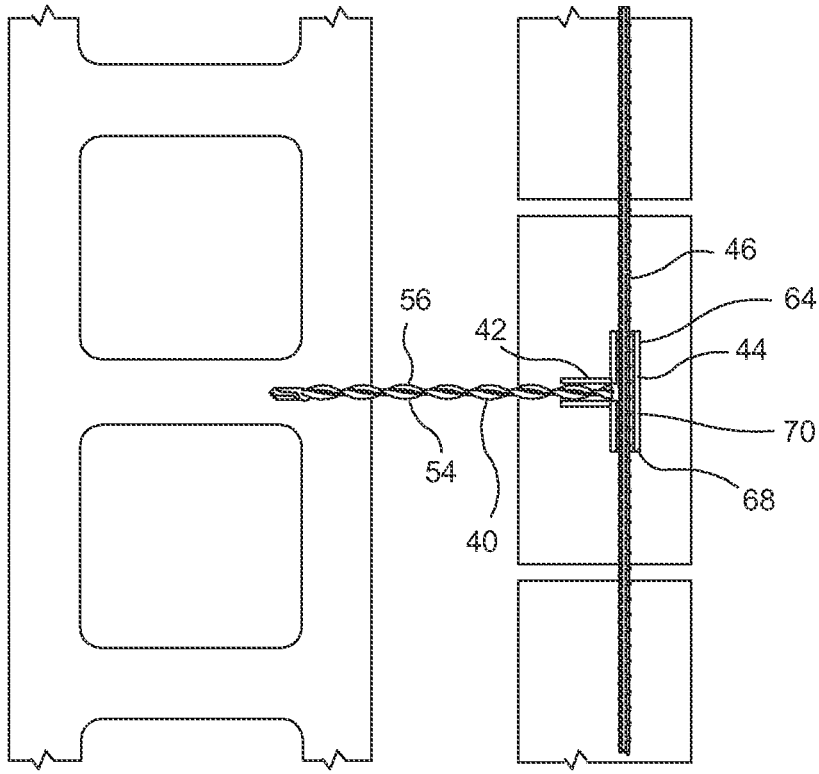
FIG. 4 is a top plan view of FIG. 1 with the bed joint mortar omitted.

The restoration anchoring system described in the embodiments herein addresses issues unique to the art of remediating and re-anchoring failing veneers in an efficient and structurally stable manner. Unlike any other structure-supporting building materials, wall anchors are relatively small, isolated assemblies that operate individually and in concert to shoulder the burden of severe forces bearing upon massive solid-wall constructs. The reconstruction and restabilization of cavity wall outer wythes or veneers experiencing cracking or spalling faces many challenges.

The present invention provides a practical and cost effective advancement in veneer re-anchoring and reinforcement through the use of a novel three-part system. The system includes a helical dowel, a seismic T-clip and a reinforcement member and works within the limited operating space of a bed joint (0.375 inches) to re-anchor and stabilize the veneer. The helical dowel acts as a spring to absorb differential movement without inducing cracking. The helical design maximizes cutting edge contact and permits simplified installation with a hammer-drive tool. Once installed, the helical anchors resist veneer loading in both compression and tension. The helix of the helical dowel minimizes retention of water in the cavity by forming and releasing droplets of water to the masonry flashing portion (not shown).

The present invention is in response to the prior art labor and materials intensive veneer re-anchoring systems. Re-anchoring and stabilization of a cavity wall veneer involves careful reinstallation of veneer ties at appropriate levels within the existing bed joint space. The present invention addresses these difficulties through the use of a novel three-part system.

Referring now to FIGS. 1 through 8, the first embodiment of a restoration seismic anchoring system of this invention is shown as applied to an existing cavity wall. The construct is referred to generally by the numeral 10. In this embodiment, a wall structure 12 is shown having an interior wythe 14 of masonry blocks 16 and an exterior wythe 18 of facing brick 20. Between the interior wythe 14 and the exterior wythe 18, a cavity 22 is formed.

In the first embodiment, successive bed joints 28 and 30 are formed between courses of bricks 20 and the joints are substantially planar and horizontally disposed. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes.

The present invention contains three components, namely, the helical dowel 40, the seismic T-clip 44 and the reinforcement member 46. The reinforcement member takes the form of another helical dowel or a wire formative, however, it is anticipated that any similar reinforcement member is within the contemplation of this invention. These restoration anchoring components, when installed within the cavity wall structure, severely restrict movement of the exterior or facing wythe in relation to the interior or backup wythe. This is accomplished by removing a portion of the existing mortar filled bed joint 30 and inserting helical dowels 40 into the masonry blocks 16, which dowels extend across the cavity 22 and are capped by an arm portion 42 of seismic T-clip 44 disposed in bed joint 30. The existing mortar in the bed joint 30 is omitted to show the full structure of the invention. A predetermined amount of the bed joint mortar is removed to accommodate the trailing end of the helical dowel 40 with the seismic T-clip 44 thereon and to accommodate the reinforcement member 46. Upon completion of the installation of the three-part system, the mortar in the bed joint 30 is replaced with new mortar or a patch [see infra]. This three-part restoration system is configurable with an existing 0.250 to 0.375 inch bed joint 30.

The helical dowel 40 contains a leading end 48 and a trailing end 50 and is threaded through an opening or pilot hole 52 in the bed joint 30 of the outer wythe 18 until secured within the inner wythe 14. The helical dowel 40 contains a core portion 54 and a vane or helix portion 56 that is helically disposed around the core portion 54 at a predetermined helix angle. The helical dowel 40 is driven into the pilot hole 52 in the bed joint 30 by a hammer drive power actuated tool. The helical form of the helical dowel 40 acts as a spring to absorb differential movement without inducing cracking. Once installed, the helical dowel 40 resists both compressive and tensile loads on the veneer. The helix of the helical dowel minimizes retention of water in the cavity by forming and releasing droplets of water to the masonry flashing portion (not shown).

Figure 7:
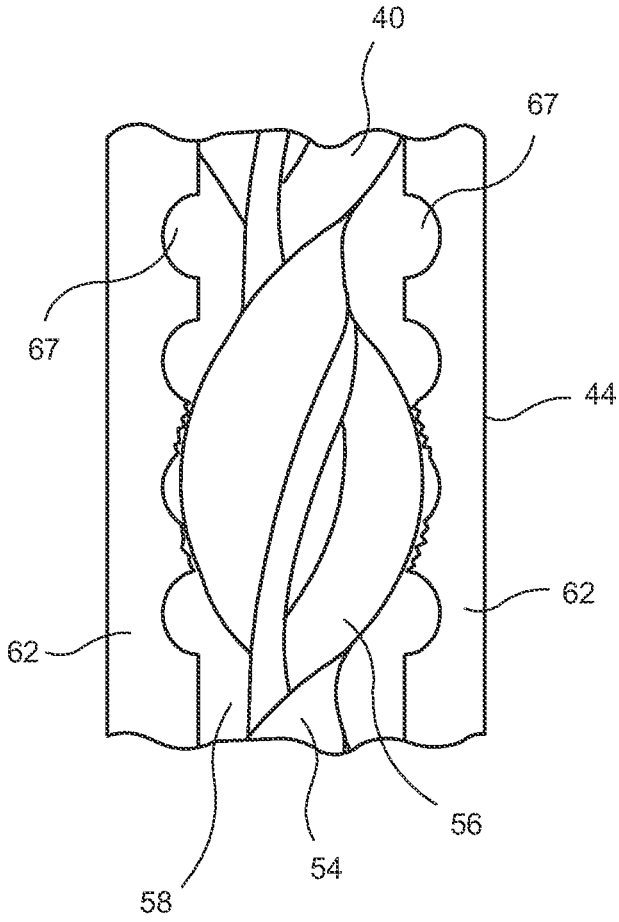
FIG. 7 is a cross-sectional view of an uninstalled T-clip having corrugated side walls.
Figure 8:
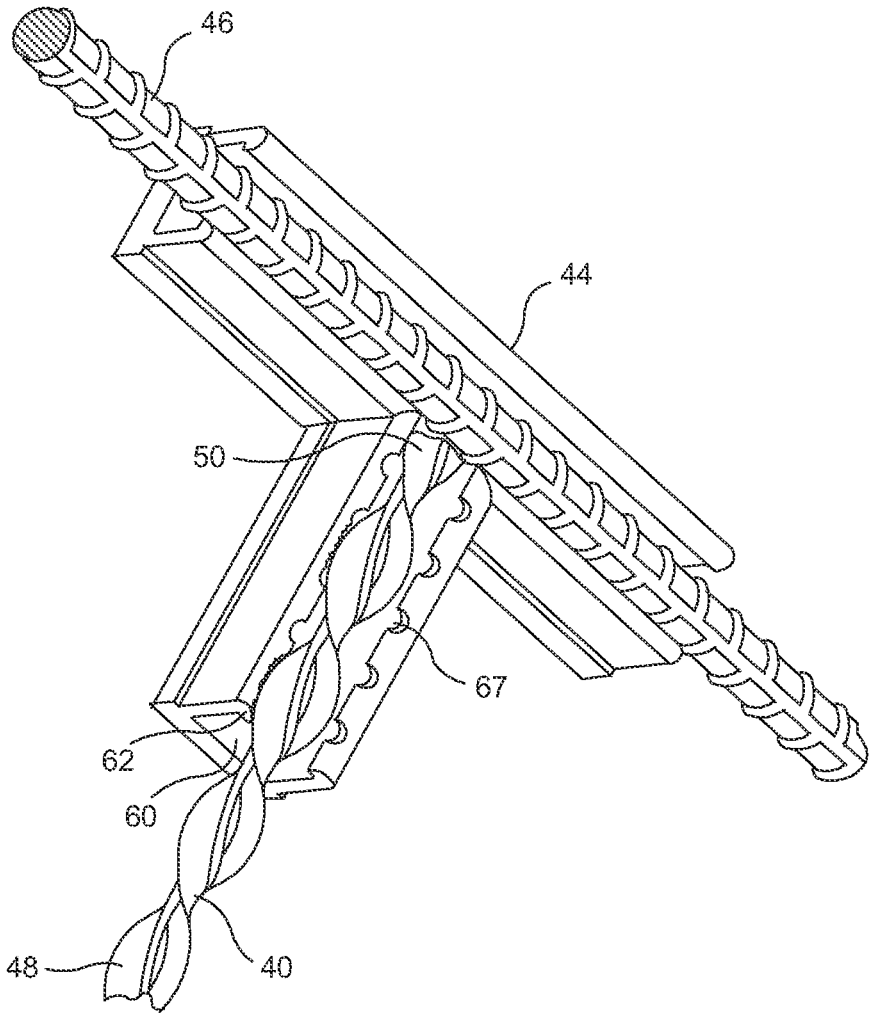
FIG. 8 is a perspective view of an uninstalled T-clip having corrugated side walls with a helical dowel and reinforcement wire set therein.

The seismic T-clip 44 is constructed for insertion into bed joint 30 and has an arm portion 42 parallel to the z-axis 38 with a connector channel 58 therein configured to accommodate the helical dowel 40. The helical dowel 40 has a core 54 and a helix 56 thereabout. Optionally, the outer diameter of the helix 56 is dimensioned to snap-fit into the throat 60 of channel 58 and so as to be retained therein by lip portions 62. Upon installation of the helical dowel 40 into the seismic T-clip 44, replacement mortar freely enters the openings in the channel aperture or throat 60 between adjacent interstitial portions of helix 56 and secures the dowel 40 to brick facing 18. Optionally, as shown in FIGS. 7 and 8, the lip portions 62 are dimensioned in a corrugated manner 67 to coincide with the vane or helix portion 56 of the helical dowel 40. Upon insertion of the helical dowel 40 into the throat 60, the helix 56 spins into the corrugated lip portions 62, 67 capturing the trailing end 50 of the helical dowel 40. Upon such insertion of the helical dowel 40 into the corrugated throat 62, 67 replacement mortar freely enters the openings in the channel aperture or throat 60 between adjacent interstitial portions of helix 56 and secures the dowel 40 to brick facing 18.

The seismic T-clip 44 is constructed with a wire or reinforcement channel portion 64 which, when the seismic T-clip 44 is installed in bed joint 30, is parallel to the x-axis 34. The channel portion 64 is dimensioned to accommodate a reinforcement wire, another helical dowel or similar structure 46. Optionally, the outer diameter of the helix 56 of the helical dowel 40 is also dimensioned to snap-fit into the throat of wire channel portion 64 and is retained therein by lip portions 70. Upon installation of the helical dowel 40 into the seismic T-clip 44, replacement mortar freely enters the openings in the aperture or throat 58 in a manner similar to that of the preceding paragraph. Although only one reinforcement wire is shown in the figures, it is within the contemplation of this invention to have multiple wire channel portions 64 similar to the seismic clip shown in U.S. Pat. No. 4,875,319.

Referring now to FIGS. 2, 3, 5 and 6, the seismic T-clip 44 is described in more detail. The clip 44 is an item of unitary construction which includes a base portion 72 underlying arm or connector channel portion 42 and wire channel portion 64. The channel or throat 58 of arm portion 42 is proportioned to accept the helical dowel 40 so that the outer edge of the helix 56 is secured therewithin. The wire channel portion 64 is similarly proportioned to accept and secure the reinforcement element 46. The channel walls 74 are sufficiently pliable so as to flex during the respective snap-in insertion of the helical dowel 40 and reinforcement element 46. The T-clip 44 is preferably formed of an injection moldable thermoplastic such as polyvinylchloride. Optionally, the bottom portion or base 76 has a plurality of v-shaped notched grooves 78 which facilitate the bonding of the T-clip 44 to the mortar which fills the bed joint 30 during the restoration of the exterior wythe 18.

Figure 9:
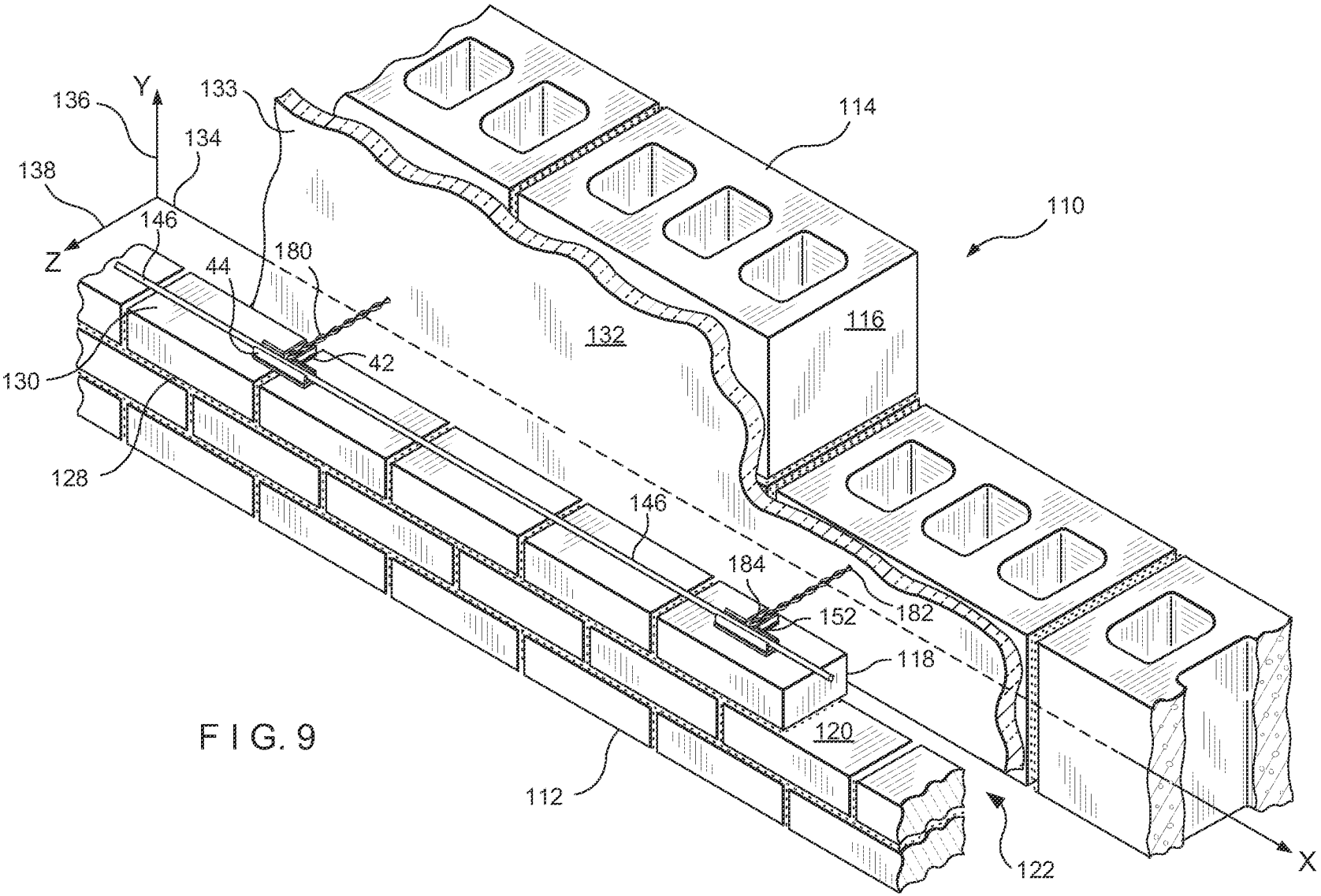
FIG. 9 is a perspective view of a second embodiment of a restoration seismic anchoring system for a cavity wall with an inner wythe of masonry block with an insulative sheathing affixed thereto and an outer wythe of brick veneer having the bed joints thereof refitted to withstand seismic exposure.
Figure 10:
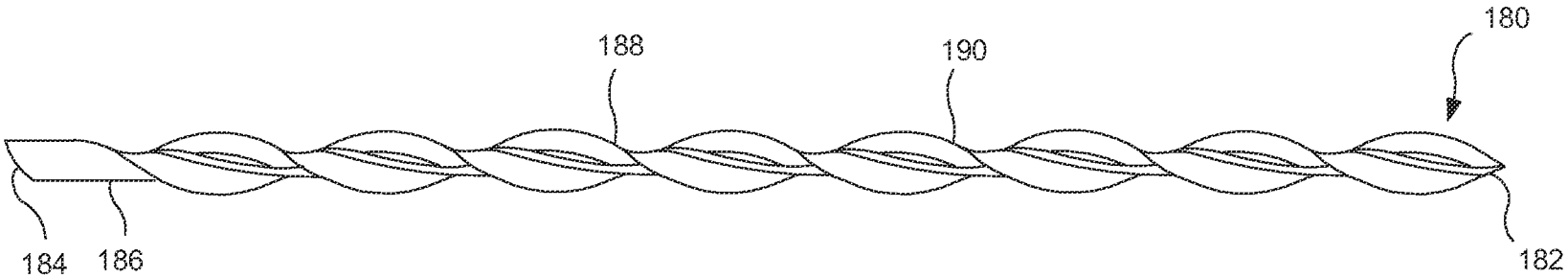
FIG. 10 is a perspective view of the helical dowel of FIG. 9.
Figure 12:
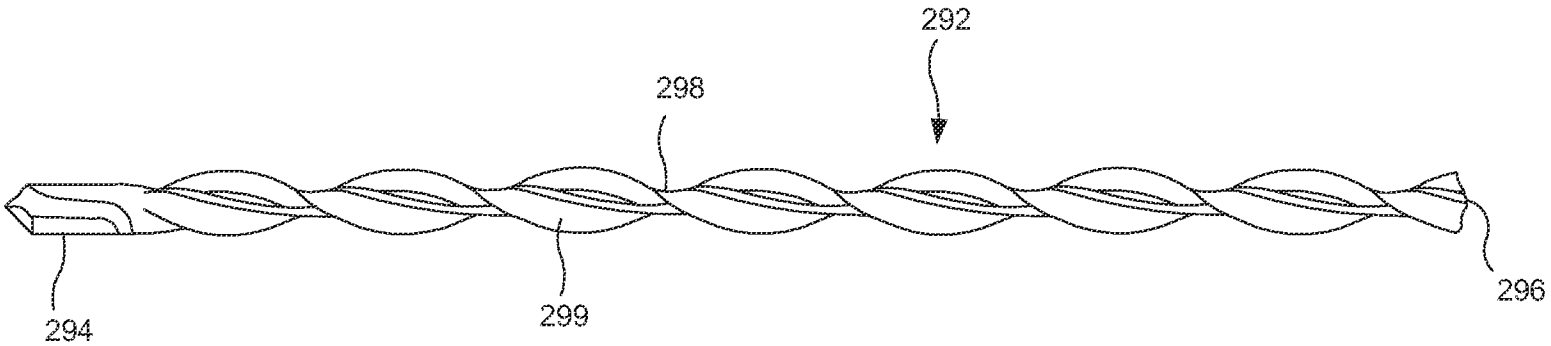
FIG. 12 is a perspective view of the helical dowel of FIG. 11 having a self-tapping tip.

The description which follows is a second embodiment of the restoration anchoring system for cavity walls of this invention. For ease of comprehension, wherever possible similar parts use reference designators 100 units higher than those above. Thus, the inner wythe 114 of the second embodiment is analogous to the inner wythe 14 of the first embodiment. Referring now to FIGS. 9 and 10, the second embodiment of the anchoring system is shown and is referred to generally by the numeral 110. As in the first embodiment, a wall structure 112 is shown having an interior wythe 114 of masonry blocks 116 and an exterior wythe 118 of facing brick 120. Between the interior wythe 114 and the exterior wythe 118, a cavity 122 is formed. In the second and third embodiments, the differences incorporated adapt the system to various building materials by changing the leading end of the helical dowel. In the second embodiment the leading end becomes self-threading; and, in the third; self-tapping, as shown in FIGS. 10 and 12.

In the second embodiment, successive bed joints 128 and 130 are formed between courses of bricks 120 and the joints are substantially planar and horizontally disposed. For purposes of discussion, the exterior surface 132 of the interior wythe 114 contains a horizontal line or x-axis 134 and an intersecting vertical line or y-axis 136. A horizontal line or z-axis 138 also passes through the coordinate origin formed by the intersecting x- and y-axes. The exterior surface of the inner wythe 114 is optionally covered in a sheathing or insulative layer 133.

The present invention contains three components, namely, the helical dowel 180, the seismic T-clip 44 and the reinforcement member 146. The reinforcement member takes the form of another helical dowel or a wire formative, however, it is anticipated that any similar reinforcement member is within the contemplation of this invention. These restoration anchoring components, when installed within the cavity wall structure, severely restrict movement of the exterior or facing wythe in relation to the interior or backup wythe. This is accomplished by removing a portion of the existing mortar filled bed joint 130 and inserting helical dowels 180 into the masonry blocks 116, which dowels extend across the cavity 122 and are capped by an arm portion 42 of seismic T-clip 44 disposed in bed joint 130. The mortar is omitted from FIG. 9 to better show the structure of the invention. A predetermined amount of the bed joint mortar is removed to accommodate the helical dowel 180 with the seismic T-clip 44 thereon and to accommodate the reinforcement member 146. Upon completion of the installation of the three-part system, the mortar in the bed joint 130 is replaced with new mortar or a patch [see infra]. This three-part restoration system is configurable with an existing 0.250 to 0.375 inch bed joint 130.

The helical dowel 180 contains a leading end 182 and a trailing end 184. The helical dowel 180 contains a core portion 186 and a vane or helix portion 188 that is helically disposed around the core portion 186 at a predetermined helix angle. The vane portion 188 is formed with a means for self-threading screwing through an opening 152 in the outer wythe 118. The self-threading construction of the vane portion 188 minimizes crushing of the insulation, maintaining insulation integrity 133, through the use of toothed means 190 for counterboring a hole through the insulation 133 upon screwing. The threaded vane portion 188 is preferably of the self-tapping type with masonry thread from end-to-end that forms similar coarse threads in a pre-drilled hole, affixing the helical dowel 180 to the inner wythe 114. Identical coarse female threads are supplied in coaxial bore in the threaded vane portion 188.

The helical form of the helical dowel 180 acts as a spring to absorb differential movement without inducing cracking. Once installed, the helical dowel 180 resists veneer loading in both compression and tension. The helix of the helical dowel minimizes retention of water in the cavity by forming and releasing droplets of water to the masonry flashing portion (not shown).

Figure 5:
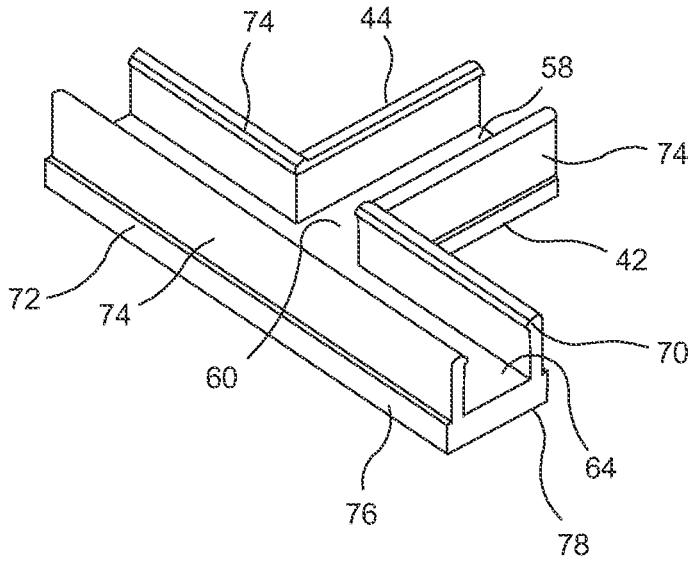
FIG. 5 is a perspective view of an uninstalled T-clip.
Figure 6:
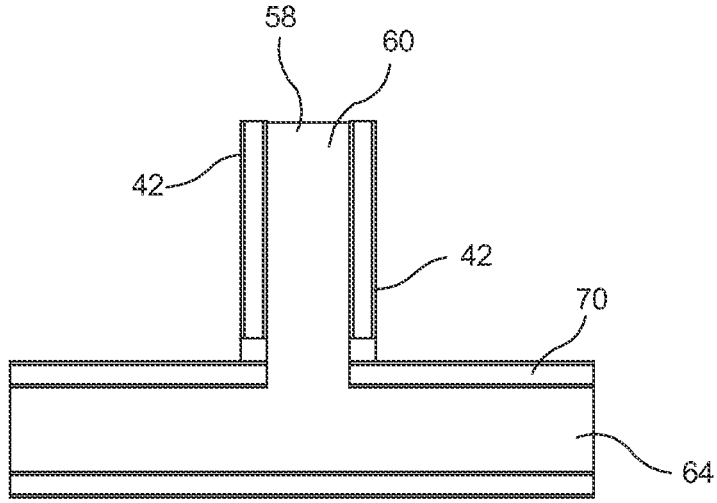
FIG. 6 is a top plan view of the T-clip of FIG. 5.

The seismic T-clip 44 is shown in detail in FIGS. 5 and 6 and is constructed for insertion into bed joint 130 and has an arm portion 42 parallel to the z-axis 138 with a connector channel 58 therein configured to accommodate helical dowel 180. The helical dowel 180 has a core 186 and a vane or helix 188 thereabout. Optionally, the outer diameter of the helix 188 is dimensioned to snap-fit into the throat 60 of connector channel 58 and so as to be retained therein by lip portions 62. Upon installation of the helical dowel 180 into the seismic T-clip 44, replacement mortar freely enters the openings in the channel throat or aperture 58 between adjacent interstitial portions of helix 188 and secures the dowel 180 to brick facing 118. Optionally, as similarly shown and described in FIGS. 7 and 8, the lip portions are corrugated to coincide with the vane or helix portion of the helical dowel.

The seismic T-clip 44 is constructed with a wire or reinforcement channel portion 64 which, when the seismic T-clip 44 is installed in bed joint 130, is parallel to the x-axis 134. The channel portion 64 is dimensioned to accommodate a reinforcement wire, another helical dowel 146 or similar structure. Optionally, the outer diameter of the helix 188 of the helical dowel 180 is also dimensioned to snap-fit into the throat of wire channel portion 64 and is retained therein by lip portions 70. Upon installation of the helical dowel 180 into the seismic T-clip 44, replacement mortar freely enters the openings in the aperture or throat 58 in a manner similar to that of the preceding paragraph. Although only one reinforcement wire is shown in the figures, it is within the contemplation of this invention to have multiple wire channel portions 64 similar to the seismic clip shown in U.S. Pat. No. 4,875,319.

Figure 11:
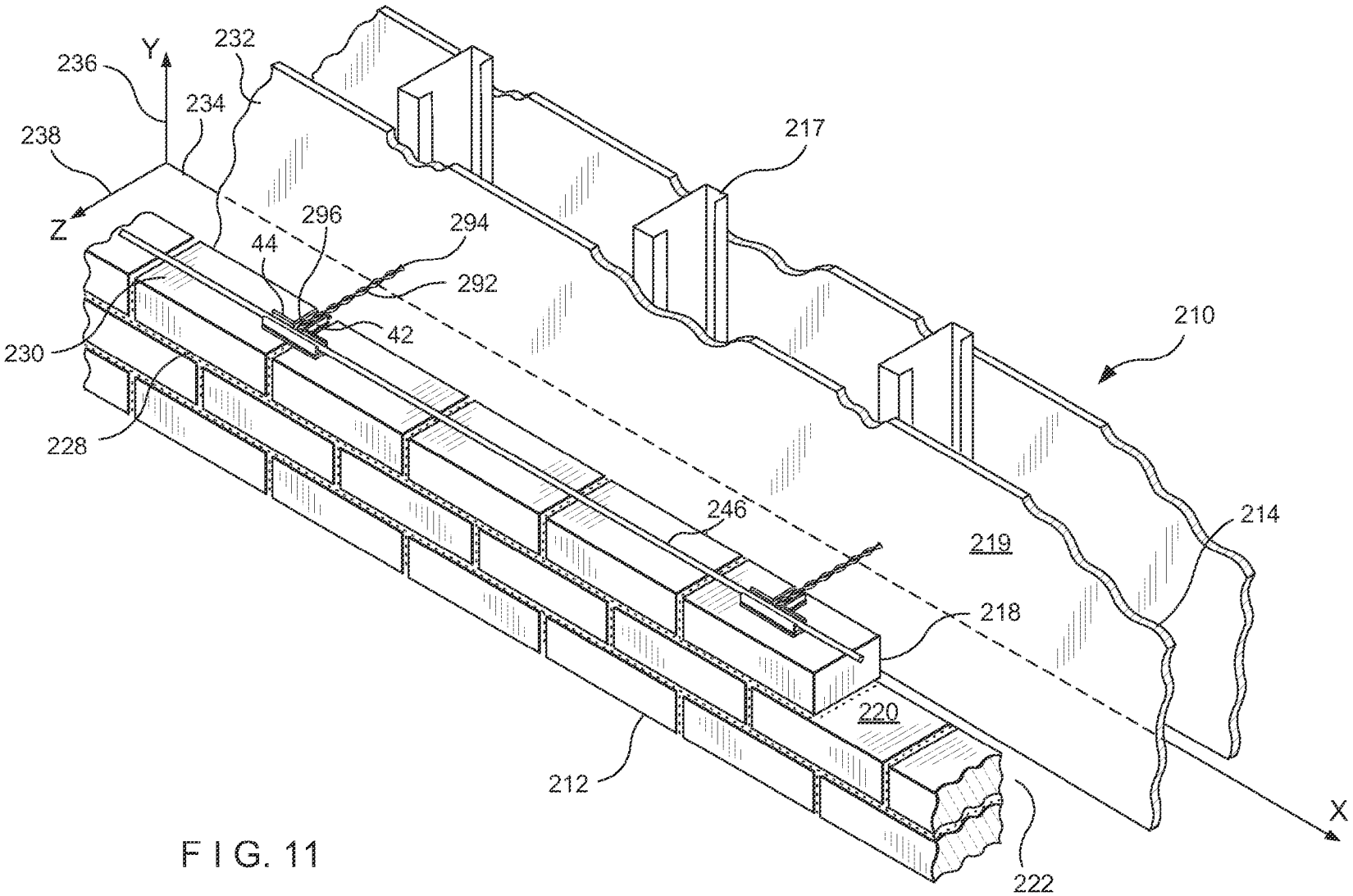
FIG. 11 is a perspective view of a third embodiment of a restoration seismic anchoring system for a cavity wall with an inner wythe of wallboard mounted on metal studs and an outer wythe of brick veneer having the bed joints thereof refitted to withstand seismic exposure.

The description which follows is a third embodiment of the restoration anchoring system for cavity walls of this invention. For ease of comprehension, wherever possible similar parts use reference designators 200 units higher than those in the first embodiment. Thus, the inner wythe 14 of the first embodiment is analogous to the inner wythe 214 of this third embodiment. Referring now to FIG. 11, the third embodiment is shown and referred to generally by the numeral 210.

A cavity wall structure 212 is shown having an inner wythe or drywall backup 214 with sheetrock or wallboard 219 mounted on metal studs or columns 217 and an outer wythe or facing wall 218 of brick 220 construction. Inner wythes constructed of masonry materials or wood framing (not shown) are also applicable. Between the interior wythe 214 and the exterior wythe 218, a cavity 222 is formed.

In the third embodiment, successive bed joints 228 and 230 are formed between courses of bricks 220 and the joints are substantially planar and horizontally disposed. For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The exterior surface of the inner wythe 214 is optionally covered in a sheathing or insulative layer (not shown).

The present invention contains three components, namely, the helical dowel 292 the seismic T-clip 44 and the reinforcement member 246. The reinforcement member takes the form of another helical dowel or a wire formative, however, it is anticipated that any similar reinforcement member is within the contemplation of this invention. These restoration anchoring components, when installed within the cavity wall structure, severely restrict movement of the exterior or facing wythe in relation to the interior or backup wythe. This is accomplished by removing a portion of the existing mortar filled bed joint 230 and inserting helical dowels 292 into the columns 216, which dowels extend across the cavity 222 and are capped by an arm portion 42 of seismic T-clip 44 disposed in bed joint 230. The mortar in bed joint 230 is omitted to more fully show the structure of the invention. A predetermined amount of the bed joint mortar is removed to accommodate the trailing end of the helical dowel 292 with the seismic T-clip 44 thereon and to accommodate the reinforcement member 246. Upon completion of the installation of the three-part system, the mortar in the bed joint 230 is replaced with new mortar or a patch [see infra]. This three-part restoration system is configurable with an existing 0.250 to 0.375 inch bed joint 230.

The helical dowel 292 contains a leading end 294 and a trailing end 296. The helical dowel 292 contains a core portion 298 and a vane or helix portion 299 that is helically disposed around the core portion 298 at a predetermined helix angle. The vane portion 299 is formed with a means for one-operation attachment to said inner wythe 214 by means of a self-drilling leading end 294 for the securement of said leading end 294 in the inner wythe 114. The helical form of the helical dowel 292 acts as a spring to absorb differential movement without inducing cracking. Once installed, the helical dowel 292 resists veneer loading in both compression and tension. The helix of the helical dowel minimizes retention of water in the cavity by forming and releasing droplets of water to the masonry flashing portion (not shown).

The seismic T-clip 44 as more fully shown in FIGS. 5 and 6, is constructed for insertion into bed joint 230 and has an arm portion 42 parallel to the z-axis 238 with a connector channel 58 therein configured to accommodate helical dowel 292. The helical dowel 292 has a core 298 and a helix 299 thereabout. Optionally, the outer diameter of the helix 299 is dimensioned to snap-fit into the throat of channel 58 and so as to be retained therein by lip portions 62. Upon installation of the helical dowel 292 into the seismic T-clip 44, replacement mortar freely enters the openings in the throat 58 between adjacent interstitial portions of helix 299 and secures the dowel 292 to brick facing 218. Optionally, as similarly shown and described in FIGS. 7 and 8, the lip portions are corrugated to coincide with the vane or helix portion of the helical dowel.

The seismic T-clip 44 is constructed with a wire or reinforcement channel portion 64 which, when the seismic T-clip 44 is installed in bed joint 230, is parallel to the x-axis 234. The channel portion 64 is dimensioned to accommodate a reinforcement wire, another helical dowel or similar structure 246. Optionally, the outer diameter of the helix 299 of the helical dowel 292 is also dimensioned to snap-fit into the throat of wire channel portion 64 and is retained therein by lip portions 270. Upon installation of the helical dowel 292 into the seismic T-clip 44, replacement mortar freely enters the openings in the throat 58 in a manner similar to that of the preceding paragraph. Although only one reinforcement wire is shown in the figures, it is within the contemplation of this invention to have multiple wire channel portions 64 similar to the seismic clip shown in U.S. Pat. No. 4,875,319.

The restoration anchoring system set forth above solves the problems of the prior art by providing a solution to the remediation and restabilization of cavity wall structures. The present invention, described above, provides a three-part system capable of reattaching displaced veneers with minimal effect on the existing veneer. The use of the helical dowel, T-clip and reinforcement member provides a greater level of worker safety at a lower cost.

The restoration anchoring system described in the embodiments herein addresses issues unique to the art of re-anchoring damaged veneers in an efficient and structurally stable manner. This invention resolves the structural issues related to the reconstruction of a veneer outer wythe, by providing a less invasive reattachment and reinforcement seismic system capable of withstanding high lateral forces. This invention further reduces other costs and elements required to reconstruct a cavity wall system.

The present invention is in response to the prior art labor and materials intensive restoration systems. Reconstruction of a cavity wall veneer is often a more difficult task than initial construction because of the existing limited bed joint space. As shown in the above embodiments, the present invention addresses the difficulties through the use of the three-part system. In addition to re-anchoring existing veneers, the present invention is utilized with initial construction.

In the above description of restoration anchoring systems for cavity walls of this invention various configurations are described and applications thereof in corresponding settings are provided. Because varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. Thus minor changes may be made without departing from the spirit of the invention.

What is claimed is:

1. A restoration anchoring system for cavity walls having an inner wythe and an outer wythe, said restoration anchoring system comprising:

a first helical dowel having a leading end and a trailing end, said helical dowel for threading through an opening in the outer wythe and for the securement of said leading end in the inner wythe;

a seismic T-clip having a connector channel and normal thereto at least one reinforcement channel, said connector channel dimensioned to receive said trailing end of said helical dowel, said reinforcement channel having a length that is greater than a width of said connector channel; and, a reinforcement member disposed within said reinforcement channel of said seismic T-clip and, in turn, embedded within said outer wythe;

whereby said restoration anchoring system, upon captively embedding said reinforcement member in said outer wythe restores the cavity wall and forms a seismic construct.

2. A restoration anchoring system as described in claim 1 wherein said reinforcement member is a second helical dowel.

3. A restoration anchoring system as described in claim 1 further comprising:

a pilot hole in said inner wythe; and, wherein said first helical dowel further comprises:

a core portion;

a vane portion helically disposed about said core portion at a predetermined helix angle, said vane portion, when hammer driven into a pilot hole in said inner wythe is configured for rotatingly securing said first helical dowel to the wall of said pilot hole of said inner wythe.

4. A restoration anchoring system as described in claim 3, where said seismic T-clip, in turn, comprises:

a base member portion;

a pair of sidewall portions spaced apart and extending from said base member about said connector channel.

5. A restoration anchoring system as described in claim 4, wherein said seismic T-clip further comprises:

an aperture extending along said connector channel and with said first helical dowel therein, said aperture for receiving mortar between said sidewalls of said seismic T-clip, said vane portion of said first helical dowel, and said core portion.

6. A restoration anchoring system as described in claim 4, wherein said seismic T-clip includes lip portions integrally formed with said sidewall portions further defining the connector channel.

7. A restoration anchoring system as described in claim 6, wherein said lip portions include corrugations configured to coincide with said vane portion whereby said corrugations capture said trailing end of said helical dowel.

8. A restoration anchoring system as described in claim 4, wherein said seismic T-clip is of unitary construction formed from a thermoplastic material.

9. A restoration anchoring system for cavity walls having an inner wythe and an outer wythe, said restoration anchoring system comprising:

a first helical dowel having a leading end and a trailing end, said helical dowel further comprising:

a core portion;

a vane portion helically disposed about said core portion at a predetermined helix angle, said vane portion having means for self-threading screwing through an opening in the outer wythe and for the securement of said leading end in the inner wythe;

a seismic T-clip having a connector channel and normal thereto at least one reinforcement channel, said connector channel dimensioned to receive said trailing end of said helical dowel, said reinforcement channel having a length that is greater than a width of said connector channel; and, a reinforcement member disposed within said reinforcement channel of said seismic T-clip and, in turn, embedded within said outer wythe;

whereby said restoration anchoring system, upon captively embedding said reinforcement member in said outer wythe restores the cavity wall and forms a seismic construct.

10. A restoration anchoring system as described in claim 9, wherein said inner wythe has a sheathing thereon, said vane of said first helical dowel further comprising means to minimize crushing of said sheathing, said means including said vane having toothed means for counterboring a hole through the sheathing upon said screwing.

11. A restoration anchoring system as described in claim 9, wherein said reinforcement member is a second helical dowel.

12. A restoration anchoring system as described in claim 9, wherein said reinforcement member is a wire formative.

13. A restoration anchoring system as described in claim 9, where said seismic T-clip, in turn, comprises:

a base member portion;

a pair of sidewall portions spaced apart and extending from said base member about said connector channel.

14. A restoration anchoring system as described in claim 11, wherein said seismic T-clip further comprises:

an aperture extending along said connector channel and with said first helical dowel therein, for receiving mortar between said sidewalls of said seismic T-clip, said vane portion of said first helical dowel, and said core portion.

15. A restoration anchoring system as described in claim 13, wherein said seismic T-clip includes lip portions integrally formed with said sidewall portions further defining the connector channel.

16. A restoration anchoring system as described in claim 15, wherein said lip portions include corrugations configured to coincide with said vane portion whereby said corrugations capture said trailing end of said helical dowel.

17. A restoration anchoring system as described in claim 13, wherein said seismic T-clip is of unitary construction formed from a plastic material.

18. A restoration anchoring system for cavity walls having an inner wythe and an outer wythe, said inner wythe having a steel component, said restoration anchoring system comprising:

a first helical dowel having a leading end and a trailing end, said helical dowel further comprising:

a core portion;

a vane portion helically disposed about said core portion at a predetermined helix angle, said vane portion having means for one-operation attachment to said inner wythe by means of a self-drilling leading end for the securement of said leading end in the inner wythe;

a seismic T-clip having a connector channel and normal thereto at least one reinforcement channel, said connector channel dimensioned to receive said trailing end of said helical dowel, said reinforcement channel having a length that is greater than a width of said connector channel, said seismic T-clip further comprising;

a base member portion;

a pair of sidewall portions spaced apart and extending from said base member about said connector channel, said sidewall portions dimensioned to capture said trailing end of said helical dowel; and a reinforcement member disposed within said reinforcement channel of said seismic T-clip and, in turn, embedded within said outer wythe;

whereby said restoration anchoring system, upon captively embedding said reinforcement member in said outer wythe restores the cavity wall and forms a seismic construct.

19. A restoration anchoring system as described in claim 18, wherein said reinforcement member is a second helical dowel.

20. A restoration anchoring system as described in claim 18, wherein said seismic T-clip further comprises:

an aperture extending along said connector channel and with said first helical dowel therein, for receiving mortar between said sidewalls of said seismic T-clip, said vane portion of said first helical dowel, and said core portion.

21. A restoration anchoring system as described in claim 18, wherein said seismic T-clip includes lip portions integrally formed with said sidewall portions further defining the connector channel.

22. A restoration anchoring system as described in claim 18, wherein said seismic T-clip is of unitary construction formed from a plastic material.

23. A seismic T-clip member for use in restoration of a cavity wall and, upon restoration, forming a seismic construct, said cavity wall having an inner wythe and an outer wythe, said seismic T-clip comprising:

a base member for a connector channel and for one or more reinforcement channels and having the longitudinal axis of said connector channel normal to the longitudinal axes of said one or more reinforcement channels, each of said one or more reinforcement channels having a length that is greater than a width of said connector channel;

a pair of connector channel sidewalls extending from said base and surrounding said connector channel; and, a plurality of reinforcement channel sidewalls extending from said base, said sidewalls providing a wall on each side of each of said one or more reinforcement channels wherein the seismic T-clip includes lip portions integrally formed with said sidewall portions further defining the connector channel, wherein said lip portions include corrugations;

wherein said base member has a plurality of grooves formed on the underside thereof.

24. A seismic T-clip member as described in claim 23 wherein said seismic T-clip member is of unitary construction.

25. A seismic T-clip member as described in claim 23 wherein said seismic T-clip member is formed from a thermoplastic material.

26. A seismic T-clip member as described in claim 25 further comprising:

an aperture along said connector channel configured to permit during restoration the inflow of replacement mortar.

27. A seismic T-clip member as described in claim 25 wherein said connector channel sidewalls further comprise a pair of lips each integrally formed with one of said pair of connector sidewalls and configured to provide a snap-fit relationship with a restoration connector.

* * * * *